US009318822B2

(12) United States Patent
Cure et al.

(10) Patent No.: US 9,318,822 B2
(45) Date of Patent: Apr. 19, 2016

(54) ELECTRICAL CONNECTOR WITH SINGLE-PIECE FASTENING DEVICES SANDWICHED BETWEEN TWO INSULATORS

(71) Applicant: HYPERTAC SA, Saint-Aubin-lés-Elbeuf (FR)

(72) Inventors: Damien André Cure, Flancourt-Catelon (FR); Thierry Camille Daniel Piocelle, Montfort-sur-Risle (FR); Didier Louvel, Tourville-la-Campagne (FR); Jean-Sébastien Lefrileux, Le Bosc-Roger-en-Roumois (FR)

(73) Assignee: HYPERTAC SA, Saint-Aubin-lès-Elbeuf (FR)

( * ) Notice: Subject to any disclaimer, the term of this patent is extended or adjusted under 35 U.S.C. 154(b) by 0 days.

(21) Appl. No.: 14/256,204

(22) Filed: Apr. 18, 2014

(65) Prior Publication Data

US 2014/0315397 A1 Oct. 23, 2014

(30) Foreign Application Priority Data

Apr. 19, 2013 (FR) ..... 13 53612

(51) Int. Cl.

| | |
|---|---|
| ***H01R 12/00*** | (2006.01) |
| ***H01R 12/70*** | (2011.01) |
| ***H01R 13/631*** | (2006.01) |
| ***H01R 12/58*** | (2011.01) |

(52) U.S. Cl.

CPC ..... *H01R 12/7082* (2013.01); *H01R 12/58* (2013.01); *H01R 12/7005* (2013.01); *H01R 12/7052* (2013.01); *H01R 13/631* (2013.01)

(58) Field of Classification Search

CPC ..... H01R 12/7082
USPC ..... 439/65, 66
See application file for complete search history.

(56) References Cited

U.S. PATENT DOCUMENTS 5,094,623 A * 3/1992 Scharf et al. ..... 439/101
5,967,803 A * 10/1999 Ho ..... 439/79

(Continued)

OTHER PUBLICATIONS

Search report and Written Opinion by French Patent Office (INPI) on Dec. 16, 2013.

*Primary Examiner* — Chandrika Prasad
(74) *Attorney, Agent, or Firm* — Michael B. Fein; Eckert Seamons Cherin & Mellott, LLC

(57) ABSTRACT

An electrical connector designed to be fastened on a daughterboard and to be plugged into a motherboard in a plugging direction, comprising: a plurality of contacts including a first end in the plugging direction designed to be in contact with the motherboard, and a second end opposite the first end in the plugging direction and designed to be in contact with the daughterboard, and at least one insulator. The connector comprises at least one single-piece fastening device, including: a fastening base on which the insulator is mounted, and one or the other, or both, of a fastening tip designed to be fastened on the daughterboard, and a guide tip protruding from the insulator in the plugging direction to be used as a guide during plugging of the connector into the motherboard. An assembly including the daughterboard and the connector is also disclosed.

9 Claims, 4 Drawing Sheets

(56) References Cited

U.S. PATENT DOCUMENTS

Figure 1:
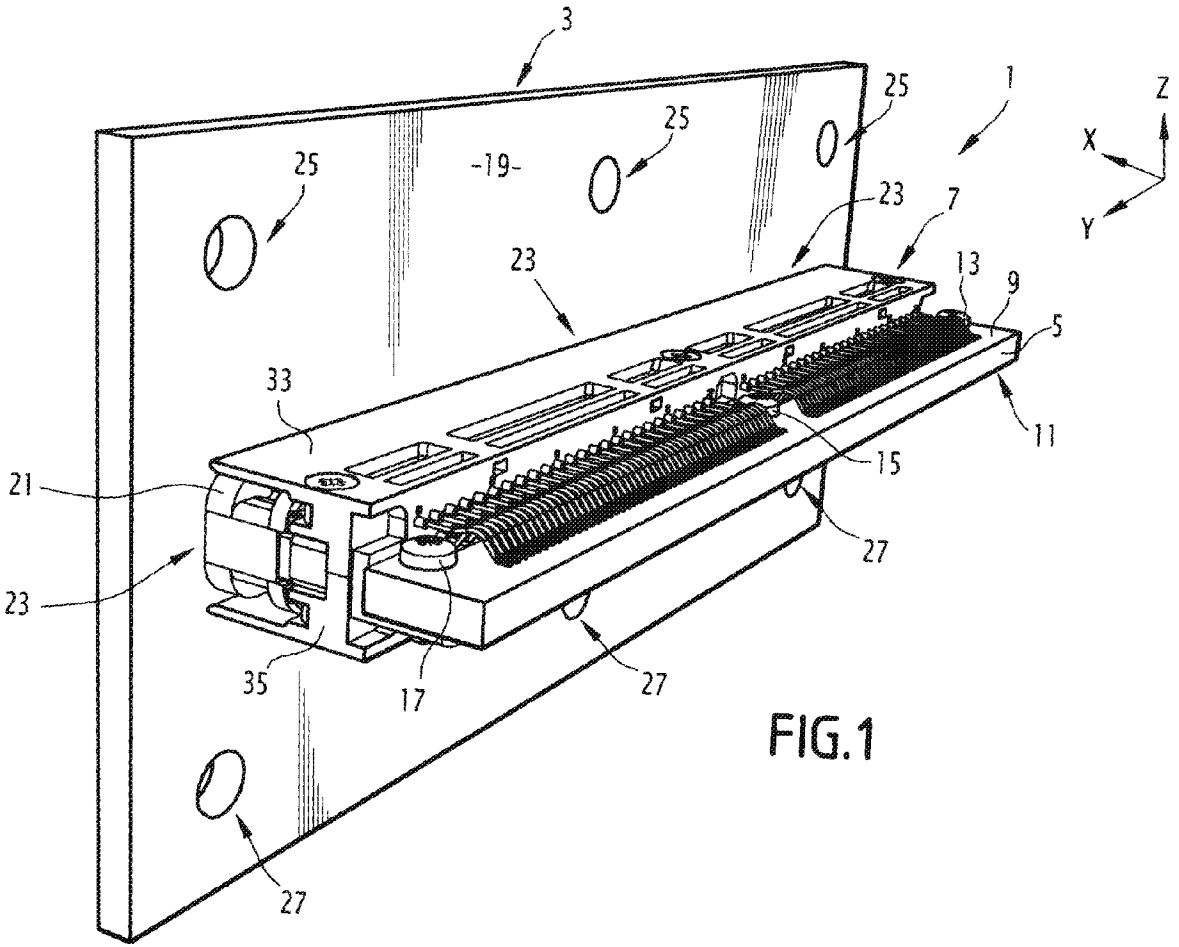

| | | | | |
|---|---|---|---|---|
| 5,967,831 | A * | 10/1999 | Yamada et al. | 439/496 |
| 6,986,682 | B1 * | 1/2006 | Jeon | 439/607.07 |
| 7,255,601 | B2 * | 8/2007 | Harper, Jr. | 439/607.07 |
| 2005/0064736 | A1 * | 3/2005 | Korsunsky et al. | 439/65 |
| 2006/0134944 | A1 * | 6/2006 | Harper, Jr. | 439/74 |
| 2007/0224857 | A1 * | 9/2007 | Harper, Jr. | 439/83 |
| 2008/0070443 | A1 * | 3/2008 | Harper, Jr. | 439/608 |
| 2008/0139010 | A1 * | 6/2008 | Havermann | 439/64 |
| 2011/0256753 | A1 * | 10/2011 | Gulla | 439/378 |

* cited by examiner

ELECTRICAL CONNECTOR WITH SINGLE-PIECE FASTENING DEVICES SANDWICHED BETWEEN TWO INSULATORS

CROSS-REFERENCE TO RELATED APPLICATIONS

The application claims the benefit of French Patent Application Serial No. 1353612, filed Apr. 19, 2013, which is hereby incorporated by reference.

BACKGROUND OF THE INVENTION

1. Field of the Invention

The present invention relates to an electrical connector designed to be fastened on a daughterboard and to be plugged into a motherboard in a plugging direction, the connector comprising:

a plurality of contacts, each contact including a first end in the plugging direction designed to be in contact with the motherboard, and a second end opposite the first end in the plugging direction and designed to be in contact with the daughterboard, and at least one insulator passed through by contacts from the plurality of contacts.

2. Description of Related Art

It is known, for example in personal computers or computer servers, to use an electrical connector to connect one or more so-called "daughterboards" to a "motherboard". The descriptors "daughter" and "mother" do not necessarily refer to distinct structural features between the two boards, but rather to the functions of the two boards. Additionally, in general, one motherboard may be connected to several daughterboards.

The connectors of the prior art generally comprise two metal beams with a planar appearance and fastened on spacers. The insulators are set, generally two by two, to multiply the number of contacts, in the interstitial spaces defined between the beams on the one hand and the spacers on the other hand. The spacers comprise a guide tip to facilitate the plugging of the connector on the motherboard. A fastening tip is fastened on each spacer to be used as a fastening support for the daughterboard. A connector with three spacers therefore in particular comprises, aside from the spacers, two beams, three fastening tips and four insulators.

The production of these parts, then their assembly in a connector that is ready to be fastened on a daughterboard, then plugged into a motherboard, incurs a relatively high production cost for the connector.

One aim of the invention is to design a connector with a lower production cost, and which preserves properties and operations for the user that are substantially equivalent to those of the connector of the prior art described above.

BRIEF SUMMARY OF THE INVENTION

To that end, the invention relates to an electrical connector of the type described above, further comprising at least one single-piece fastening device, the fastening device including:

a fastening base on which the insulator is mounted, and one or the other, or both, of a fastening tip designed to be fastened on the daughterboard, and a guide tip protruding from the insulator in the plugging direction to be used as a guide during plugging of the connector into the motherboard.

According to other specific embodiments, the connector may comprise one or more of the following features, considered alone or according to all technically possible combinations:

the or each fastening device includes the guide tip, and the guide tip comprises a substantially cylindrical proximal part and a pointed distal part oriented substantially in the plugging direction;

the connector comprises at least two insulators made in a single piece and mounted on the fastening base, each insulator being passed through by contacts from the plurality of contacts, the fastening device being sandwiched between the two insulators;

the connector comprises at least two fastening devices sandwiched between the two insulators, each of the insulators being mounted on each of the fastening devices;

the first end of each contact is a male end, each insulator including: a body passed through by the contacts passing through said insulator, and one or more protective walls protruding from the body substantially in the plugging direction to protect first ends of the contacts; the body, the protective walls and the first ends forming a plug designed to be plugged into the motherboard;

each insulator includes a single protective wall, the protective wall extending in a transverse direction substantially perpendicular to the plugging direction over a width substantially equal to the width of the body of said insulator, the protective walls being situated across from one another and the first ends of the contacts being situated between the protective walls in a direction substantially perpendicular to the plugging direction and the transverse direction;

the fastening base forms a radial bulge around an axis of the or each fastening device substantially parallel to the plugging direction, the bulge being received in a housing defined by the or each insulator, the bulge including at least one blocking face for blocking the rotation of the or each fastening device relative to the or each insulator around the axis of the or each fastening device;

the fastening base and the fastening tip respectively define two stop surfaces, the or each insulator having a protuberance situated between the two stop surfaces in the plugging direction, the stop surfaces cooperating with the protuberance to block the translation of the or each fastening device relative to the or each insulator in the plugging direction both ways;

the or each insulator is made from a liquid crystal polymer and the or each fastening device is made from stainless steel.

The invention also relates to an assembly including a daughterboard and a connector as described above; the connector being fastened on the daughterboard; the first end of the contacts being in contact with the daughterboard; the fastening tip of the or each fastening device being fastened on the daughterboard.

BRIEF DESCRIPTION OF THE SEVERAL VIEWS OF THE DRAWING(S)

Figure 2:
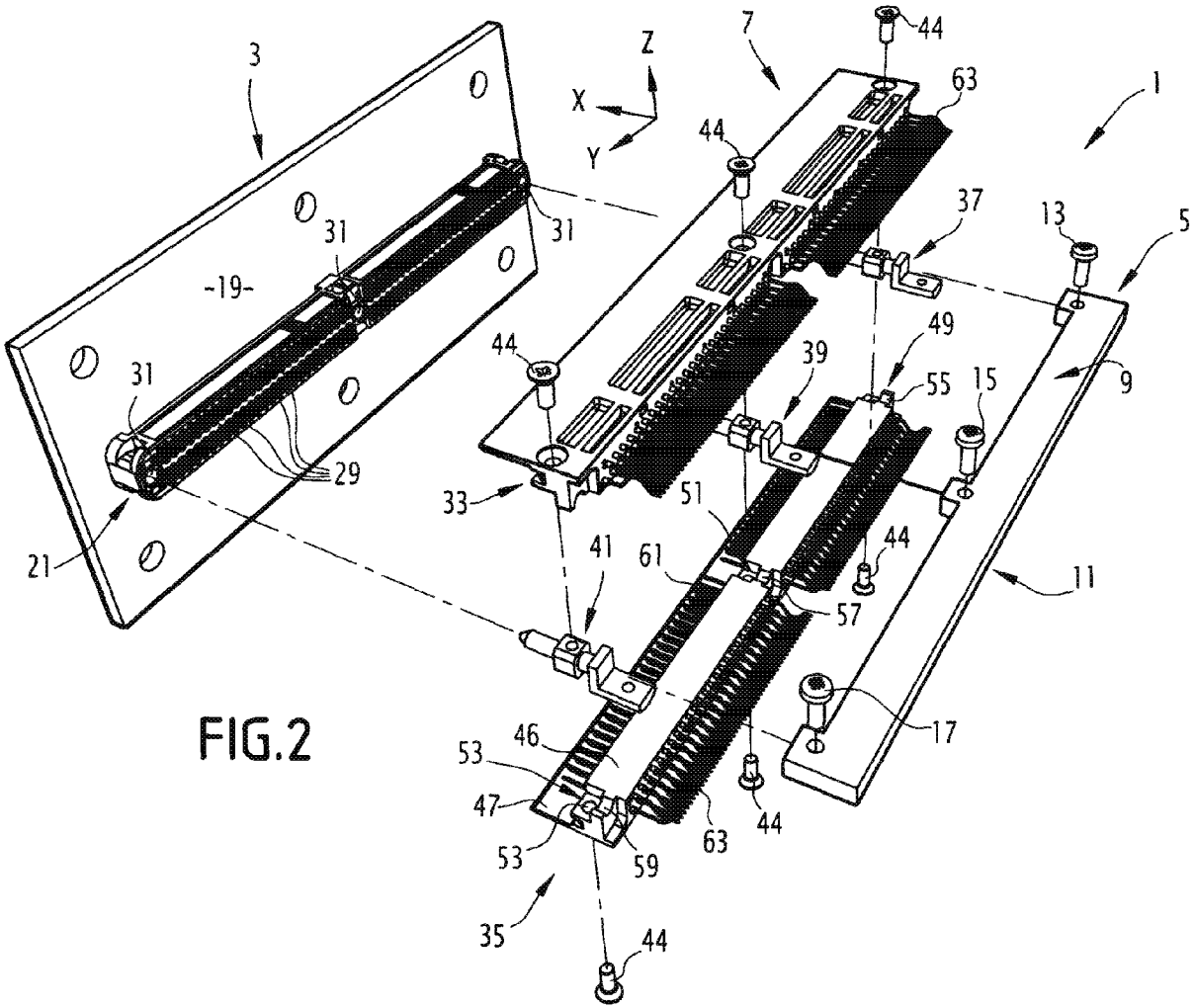
Figure 3:
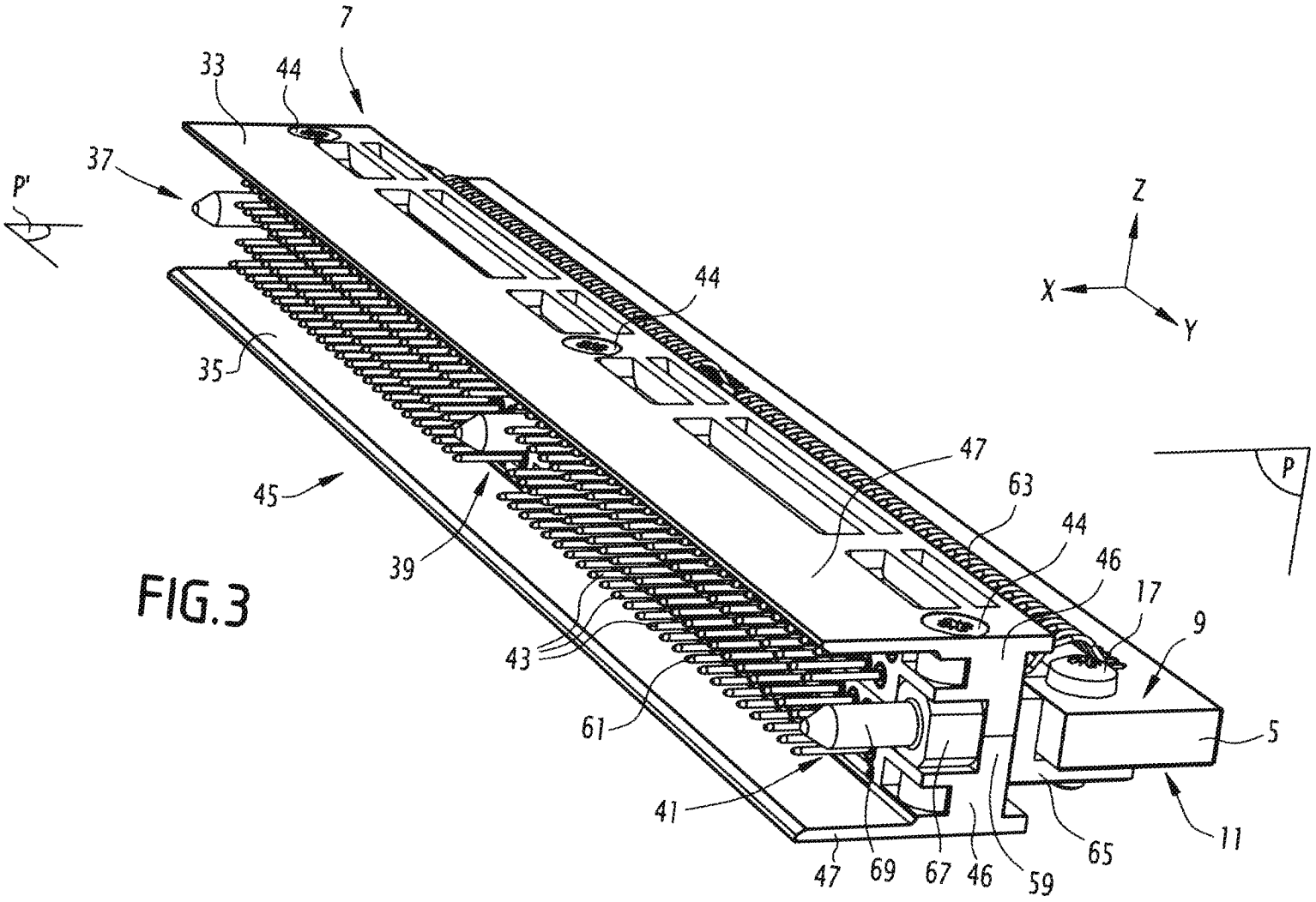
Figure 4:
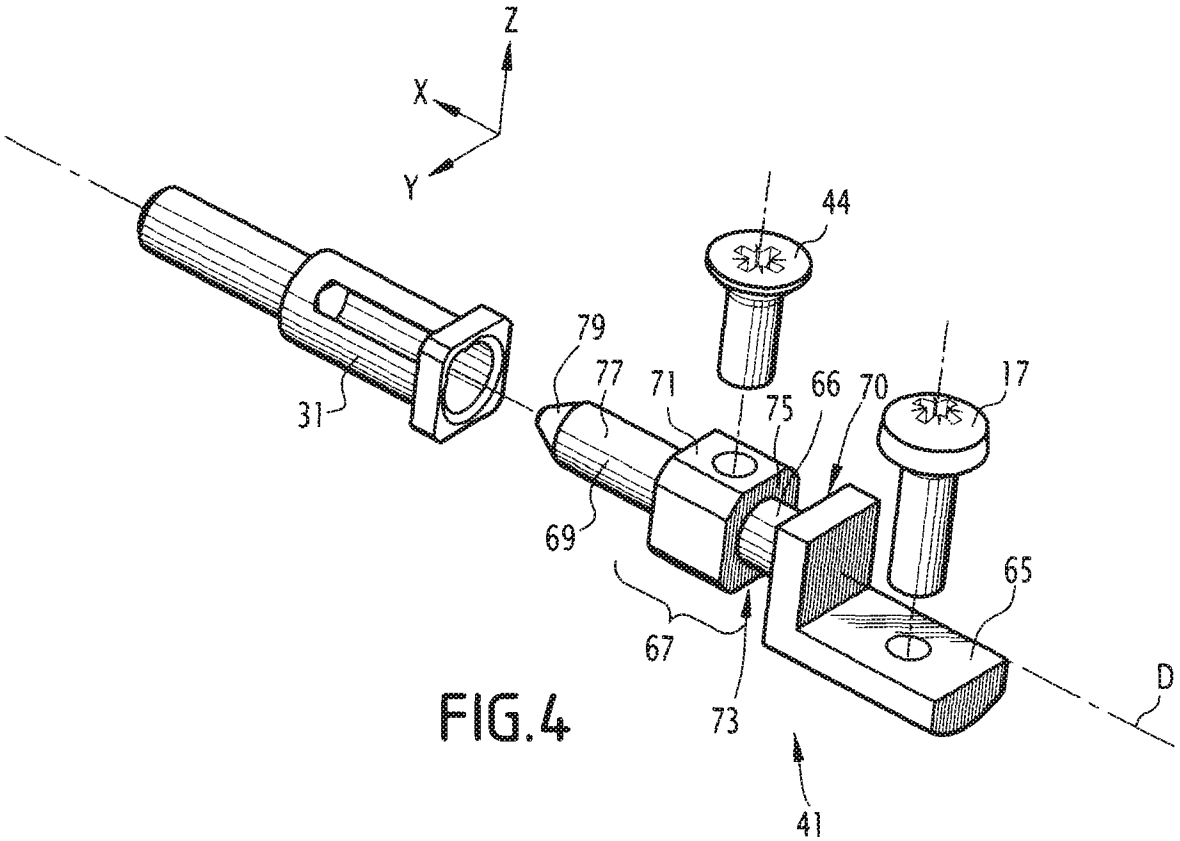

The invention will be better understood upon reading the following description, provided solely as an example, and done in reference to the appended drawings, in which:

FIG. 1 is a perspective view of an assembly including a motherboard, a connector according to the invention, and a daughterboard, FIG. 2 is a partially exploded view of the assembly shown in FIG. 1, FIG. 3 is a perspective view, from another angle, of the connector shown in FIGS. 1 and 2, and FIG. 4 is a perspective view showing one of the fastening devices for the connector shown in FIGS. 1 to 3.

DETAILED DESCRIPTION OF THE INVENTION

In reference to FIGS. 1 and 2, an assembly 1 is described comprising a motherboard 3, a daughterboard 5, and an electrical connector 7 (hereinafter "connector") to electrically connect the daughterboard 5 to the motherboard 3 by plugging the connector 7 into the motherboard in a plugging direction X.

In the illustrated example, the plugging direction X is substantially horizontal. A transverse direction Y, for example horizontal, is also defined, substantially perpendicular to the plugging direction X, and a direction Z substantially perpendicular to the plugging direction X and the transverse direction Y, for example vertical.

The daughterboard 5 is for example a traditional printed board. The daughterboard 5 is for example in the general form of a plate. The daughterboard 5 has an elongated shape in the transverse direction Y. The daughterboard 5 is substantially horizontal.

The daughterboard 5 includes an upper face 9, a lower face 11, and electronic components (not shown), in particular situated on the upper face 9 and the lower face 11. The daughterboard 5 further includes screws 13, 15, 17 for fastening the daughterboard 5 on the connector 7.

There are for example three screws 13, 15, 17 that are situated at the middle and ends of the daughterboard 5 in the transverse direction Y.

The motherboard 3 comprises a board 19 and a base 21 allowing the connector 7 to be plugged in in the plugging direction X.

The board 19 is for example a traditional printed board, including circuits and electronic components (not shown). The board 19 extends substantially perpendicular to the plugging direction X. The board 19 comprises a series of orifices 23 (not shown in FIGS. 1 and 2, since they are situated behind the base 21) for fastening the base 21 on the board 19. The board 19 advantageously includes other series of orifices 25, 27 that are designed to allow the fastening of other plugs (not shown) similar to the base 21 designed to receive other connectors similar to the connector 7 so as to connect other daughterboards (not shown) to the motherboard 3.

The base 21 is for example a female plug, of a type known in itself. The base 21 extends primarily in the transverse direction Y. The base 21 comprises female contacts 29 (FIG. 2) electrically connected to the circuits of the board 19, and guide members 31 to guide the connector 7 during its insertion in the base 21.

The female contacts 29 are for example organized in four parallel rows extending transversely.

There are for example three guide members 31 that are of the female type. They are advantageously positioned at the middle and transverse ends of the base 21.

As shown in FIGS. 2 and 3, the connector 7 comprises two insulators 33, 35, fastening devices 37, 39, 41 on which the insulators 33, 35 are mounted, and a plurality of contacts 43 passing through the insulators 33, 35. The connector 7 further comprises screws 44 for mounting the insulators 33, 35 of the fastening devices 37, 39, 41.

The connector 7 for example has a plane of symmetry P (FIG. 3) perpendicular to the transverse direction Y. Alternatively (not shown), the connector 7 does not have any such symmetry.

On the motherboard 3 side, the connector 7 forms a plug 45 (FIG. 3) complementary to the base 21.

The base 44 is of the male type in the example.

The insulators 33, 35 bear the contacts 33. The insulators 33, 35 and the fastening devices 37, 39, 41 form a framework of the connector 7.

In the example, the insulators 33, 35 are symmetrical to one another in a horizontal plane P' (FIG. 3). Consequently, only the insulator 35, situated in the bottom part of the connector 7, will be described in detail hereinafter.

The insulator 35 comprises a body 46 with a general substantially parallelepiped shape extending transversely, and a protective wall 47 protruding from the body 46 along the plugging direction X. The insulator 35 is advantageously made in a single piece, preferably molded. The insulator 35 is for example made from liquid crystal polymer (LCP).

The body 46 includes through housings oriented in the plugging direction X, to receive part of the contacts 43. The body 46 further defines housings 49, 51, 53 suitable for receiving the fastening devices 37, 39, 41. The body 46 includes vertical recesses emerging in the 49, 51, 53 for the passage of the fastening screws 44 for fastening the insulator 35 on the fastening devices 37, 39, 41. The body 46 further includes protuberances 55, 57, 59 oriented upward. The body 46 has recesses emerging on a lower face (not shown in figures, but the symmetrical recesses belonging to the insulator 33 are visible on an upper face of the insulator 33). These recesses facilitate molding.

The protuberances 55, 57, 59 form a vertical wall separating the housings 47, 49, 51, 53 into two parts in the plugging direction X.

The protective wall 47 is planar and, in the illustrated example, substantially horizontal. The wall 47 is for example situated in the extension of a lower face of the body 46 in the plugging direction X. The protective wall 47 advances much further toward the base 21 (FIG. 2) in the plugging direction X than the contacts 43.

The contacts 43 are for example organized in four rows parallel to each other and extending transversely. The contacts 43 of the two upper rows are anchored in the insulator 33, while the contacts 43 of the two lower rows are anchored in the insulator 35.

Each contact 43 comprises a first end 61 in the plugging direction X suitable for being received in the female contacts 29 of the base 21, and a second end 63, opposite the first end in the plugging direction and producing the contact with the daughterboard 5.

Each first end 61 is for example a pin protruding from the body 46 of one of the insulators 33, 35 in the plugging direction X.

Each second end 63 for example includes a bowed part and an end part advantageously welded on the daughterboard 5. The two ends 63 of the contacts 43 passing through the insulator 33 are fastened on the upper face 9 of the daughterboard 5, while the second ends 63 of the contacts 43 passing through the insulator 35 are fastened on the lower face 11 of the daughterboard 5.

There are for example three fastening devices 37, 39, 41. They are advantageously positioned at the middle and the transverse ends of the connector 7. They are for example made from stainless steel. They are sandwiched between the insulators 33, 35. Each fastening device 37, 39, 41 has a shape generally elongated along the plugging direction X.

The fastening devices 37, 39, 41 advantageously being structurally identical to each other, only the fastening device 41 will be described hereinafter in reference to FIG. 4.

The fastening device 41 is made in a single piece. The fastening device 41 comprises, successively along an axis D parallel to the plugging direction X, a fastening tip 65 fastened on the daughterboard 5, an intermediate segment 66 that is for example cylindrical, a fastening base 67 on which the insulators 33, 35 are fastened, and a guide tip 69 protruding from the insulators 33, 35 in the plugging direction X toward the base 21.

The fastening tip 67 is for example in the shape of an L suitable for receiving the daughterboard 5. The staff of the L is substantially horizontal and is for example pressed against the lower face 11 of the daughterboard 5. The staff is pierced to receive the fastening screw 17 for fastening the daughterboard 5. The base of the L is situated on the side of the fastening base 67 and is substantially perpendicular to the axis D. The base of the L forms, on the fastening base 67 side, a stop surface 70 for the protuberance 59 of the insulators 33, 35 in the plugging direction X.

The fastening base 67 has a generally cubic shape, whereof the edges parallel to the axis D are beveled. The fastening base 67 further includes two vertical tapped piercings respectively emerging on an upper horizontal face 71 and a lower horizontal face 73 to receive the fastening screws 44 for the insulators 33, 35. The fastening base 67 forms, on the side of the fastening tip 65, a stop surface 75 for the protuberance 59 of the insulators 33, 35 in the plugging direction X, in a sense affixed to that connected to the stop surface 70.

The fastening base 67 forms a radial bulge of the fastening device 41 around the axis D.

The upper face 71 further constitutes a blocking face for blocking the rotation of the fastening device 41 around the axis D relative to the insulator 33.

Likewise, the lower face 73 constitutes a blocking face for blocking the rotation of the fastening device 41 around the axis D relative to the insulator 35.

The guide tip 69 includes a cylindrical proximal part 77 with a circular base with axis D, and a conical distal part 79 oriented toward the base 21 in the plugging direction X.

The plug 45 formed by the connector 7 is of the male type in the illustrated example. The base 44 is formed by the first ends 61 of the contacts 43, the guide tips 69, the protective walls 47 and the faces of the insulators 33, 35 turned toward the base 21.

The operation of the assembly 1 results directly from its structure and will now be described. We will first describe the mounting of the connector 7, then the fastening of the daughterboard 5 on the connector and the plugging of the connector 7 into the motherboard 3, and lastly the overall operation of the assembly 1.

To mount the connector 7, the contacts 43 are fastened in the insulators 33, 35. For example, the contacts 43 are forcibly anchored in the insulators 33, 35.

Then, each insulator 33, 35 is mounted on the fastening devices 37, 39, 41 by screwing the screws 44 into the fastening base 67 (FIG. 4) of each fastening device 37, 39, 41. The fastening bases 67 are then received in the housings 49, 51, 53 of each insulator 33, 35. The protuberances 55, 57, 59 are situated between the fastening bases 67 and the fastening tips 65 in the plugging direction X. The protuberances 55, 57, 59 abut on the one hand against the stop surfaces 70, 75, which immobilizes the translation of the fastening devices 37, 39, 41 relative to the insulators 33, 35 in the plugging direction X. Furthermore, the upper face 71 of the fastening base 67 and the lower face 73 respectively cooperate with the insulators 33, 35 to immobilize the rotation of the fastening devices 37, 39, 41 relative to the insulators 33, 35, respectively, around the plugging direction X. The fastening devices 37, 39, 41 are immobilized in a position such that the fastening tips 65 are capable of receiving the daughterboard 5.

The insulators 33, 35 are capable by themselves, once fastened on the fastening devices 37, 39, 41, of ensuring the mechanical cohesion of the connector 7, with the exception of any other part. In particular, the connector 7 lacks any beam connecting two of the fastening devices 37, 39, 41. The daughterboard 5 and the motherboard 3 are not considered here to make up beams of the connector 7.

The daughterboard 5 and the connector 7 are fastened on one another by screwing the screws 13, 15, 17 in the fastening tips 65. The second ends 66 of the contacts 43 are welded on the circuits (not shown) of the daughterboard 5.

To connect the daughterboard 5 to the motherboard 3, the plug 45 formed by the connector 7 is plugged into the base 21 of the motherboard 3 in the plugging direction X. The first end 61 of each contact 43 of the connector 7 enters a corresponding female contact 29 of the base 21.

Furthermore, the protective walls 47 protect the first ends 61, in particular in case of impact of the connector 7 with a surface (not shown), and in all directions of relative movement of the connector 7 and said surface.

At the beginning of plugging of the plug 45 into the base 21, the distal part 79 of each guide tip 69, then the proximal part 69 enter the corresponding housing 31 of the base 21. This guarantees that the first ends 61, in the form of a pin, are properly aligned with the contacts 29 in the plugging direction X.

After the plugging, the circuits of the daughterboard 5 are connected to those of the motherboard 3 via the contacts 43 of the connector 7 and the female contacts 29 of the base 21.

Owing to the features described above, the connector 7 comprises fewer parts than a connector of the prior art. In fact, the connector 7, compared to the connector with three spacers described in the preamble of the present document, does not include beams, or fastening tips separate from the spacers, and only two insulators instead of four for same number of contacts 43 and a substantially identical arrangement of the contacts 43 in the insulators 33, 35. The connector 7 therefore has seven fewer parts than the equivalent connector of the prior art. Thus, the production cost of the connector 7 is lower.

Furthermore, the mounting of the connector 7 on the daughterboard 5 is made easier for the user, since there are no additional tips to be fastened on the beams.

Furthermore, once mounted, the connector 7 preserves properties and operations for the user that are substantially equivalent to those of the connector of the prior art.

According to one alternative (not shown), the connector 7 only includes one insulator, for example the insulator 33, and one fastening device, for example the fastening device 39. The insulator 33 is modified to receive all of the contacts 43.

According to another alternative (not shown), the connector 7 includes only one fastening device 39 and two insulators 33, 35.

According to another alternative (not shown), the connector 7 only includes two fastening devices, for example the fastening devices 37 and 41, and two insulators similar to those shown in FIG. 2.

According to another alternative (not shown), the first ends 61 of the contacts 43 are of the female type, and the contacts 29 of the base 21 are of the male type.

According to another alternative (not shown), the guide tips 69 are of the female type and the housings 31 of the base 21 are replaced by tips of the male type cooperating with the guide tips 69.

According to another alternative (not shown), the fastening tips 65 are modified to receive the daughterboard 5 positioned parallel to the motherboard 3, and not perpendicular as in the illustrated example. The shape of the second ends 63 of the contacts 43 is modified accordingly.

The invention claimed is:

1. An electrical connector designed to be fastened on a daughterboard and to be plugged into a motherboard in a plugging direction, the connector comprising:

a plurality of contacts, each contact including a first end in the plugging direction designed to be in contact with the motherboard, and a second end opposite the first end in the plugging direction and designed to be in contact with the daughterboard, and at least one insulator passed through by contacts from the plurality of contacts, the connector further comprising at least one single-piece fastening device, the fastening device including:

a fastening base on which the insulator is mounted, and one or the other, or both, of a fastening tip designed to be fastened on the daughterboard, and a guide tip protruding from the insulator in the plugging direction to be used as a guide during plugging of the connector into the motherboard;

the connector comprising at least two single piece insulators mounted on the fastening base, each insulator being passed through by contacts from the plurality of contacts, at least one single-piece fastening device being sandwiched between the two insulators.

2. The connector according to claim 1, wherein:

each fastening device includes the guide tip, and the guide tip comprises a substantially cylindrical proximal part and a pointed distal part oriented substantially in the plugging direction.

3. The connector according to claim 1, comprising at least two fastening devices sandwiched between the two insulators, each of the insulators being mounted on each of the fastening devices.

4. The connector of claim 1, wherein the first end of each contact is a male end, each insulator including:

a body passed through by the contacts passing through said insulator, and one or more protective walls protruding from the body substantially in the plugging direction to protect first ends of the contacts, the body, the protective walls and the first ends forming a plug designed to be plugged into the motherboard.

5. The connector according to claim 4, wherein each insulator includes a single protective wall, the protective wall extending in a transverse direction substantially perpendicular to the plugging direction over a width substantially equal to the width of the body of said insulator, the protective walls being situated across from one another and the first ends of the contacts being situated between the protective walls in a direction substantially perpendicular to the plugging direction and to the transverse direction.

6. The connector of claim 1, wherein the fastening base forms a radial bulge around an axis of each fastening device substantially parallel to the plugging direction, the bulge being received in a housing defined by each insulator, the bulge including at least one blocking face for blocking the rotation of each fastening device relative to each insulator around the axis of each fastening device.

7. The connector of claim 1, wherein the fastening base and the fastening tip respectively define two stop surfaces, each insulator having a protuberance situated between the two stop surfaces in the plugging direction, the stop surfaces cooperating with the protuberance to block the translation of each fastening device relative to each insulator in the plugging direction both ways.

8. The connector of claim 1, wherein each insulator is made from a liquid crystal polymer and each fastening device is made from stainless steel.

9. An assembly including a daughterboard and a connector of claim 1; the connector being fastened on the daughterboard; the second end of the contacts being in contact with the daughterboard; the fastening tip of each fastening device being fastened on the daughterboard.

* * * * *